US011421902B2

(12) United States Patent
Leemeijer

(10) Patent No.: US 11,421,902 B2
(45) Date of Patent: Aug. 23, 2022

(54) APPARATUS FOR DELIVERING CIRCULATING WATER AND SYSTEM FOR DELIVERING CIRCULATING WATER INCLUDING THE SAME

(71) Applicant: Samsung Electronics Co., Ltd., Suwon-si (KR)

(72) Inventor: Rolf Leemeijer, Amsterdam (NL)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/056,204

(22) PCT Filed: May 31, 2018

(86) PCT No.: PCT/KR2018/006213
§ 371 (c)(1),
(2) Date: Nov. 17, 2020

(87) PCT Pub. No.: WO2019/231017
PCT Pub. Date: Dec. 5, 2019

(65) Prior Publication Data
US 2021/0215366 A1 Jul. 15, 2021

(51) Int. Cl.
*F24F 11/83* (2018.01)
*F24F 1/00* (2019.01)
(Continued)

(52) U.S. Cl.
CPC ..... *F24F 11/30* (2018.01); *F24F 1/00077* (2019.02); *F24F 1/26* (2013.01);
(Continued)

(58) Field of Classification Search
CPC .. F25B 7/00; F25D 17/02; F25D 29/00; F24F 11/0008; F24F 11/30; F24F 11/83;
(Continued)

(56) References Cited

U.S. PATENT DOCUMENTS 7,454,919 B2 * 11/2008 Ookoshi ..... F24D 17/02 62/156
8,850,837 B2 * 10/2014 Park ..... F25B 7/00 62/160
(Continued)

FOREIGN PATENT DOCUMENTS

EP 2 927 609 A1 10/2015
JP 2005-221194 A 8/2005
(Continued)

OTHER PUBLICATIONS

European Office Action dated Apr. 1, 2021, issued in European Application No. 18 920 622.0.
(Continued)

*Primary Examiner* — Jerry-Daryl Fletcher
*Assistant Examiner* — Daniel C Comings
(74) *Attorney, Agent, or Firm* — Jefferson IP Law, LLP

(57) ABSTRACT

An apparatus for delivering circulating water includes a cooling/warming controller configured to perform heat exchange of circulating water supplied to a cooling/warming apparatus using a refrigerant; an indoor-unit controller configured to perform heat exchange of circulating water supplied to an indoor unit using the refrigerant; and a mode change unit (MCU) configured to control a flow of the refrigerant supplied to the cooling/warming controller and the indoor-unit controller according to an operation mode of the cooling/warming apparatus and the indoor unit. The cooling/warming controller and the indoor-unit controller may be configured to share a circulating water passage through which the circulating water moves.

10 Claims, 6 Drawing Sheets

(51) Int. Cl.

| | |
|---|---|
| ***F25D 17/02*** | (2006.01) |
| ***F24F 11/30*** | (2018.01) |
| ***F24F 11/84*** | (2018.01) |
| ***F24F 11/86*** | (2018.01) |
| ***F24F 1/0007*** | (2019.01) |
| ***F24F 1/26*** | (2011.01) |
| ***F24F 3/14*** | (2006.01) |
| ***F24F 11/00*** | (2018.01) |
| ***F25D 29/00*** | (2006.01) |
| *F25B 7/00* | (2006.01) |

(52) U.S. Cl.
CPC ..... *F24F 3/14* (2013.01); *F24F 11/0008* (2013.01); *F24F 11/84* (2018.01); *F24F 11/86* (2018.01); *F25D 17/02* (2013.01); *F25D 29/00* (2013.01); *F24F 2221/54* (2013.01); *F25B 7/00* (2013.01)

(58) Field of Classification Search
CPC .. F24F 1/00077; F24F 1/26; F24F 3/14; F24F 2221/54; F24F 11/84; F24F 11/86
See application file for complete search history.

(56) References Cited

U.S. PATENT DOCUMENTS

| | | | | |
|---|---|---|---|---|
| 9,651,281 | B2 * | 5/2017 | Jeon | F25B 47/02 |
| 2010/0018224 | A1 * | 1/2010 | Zhang | F25B 25/005 62/6 |
| 2011/0225998 | A1 * | 9/2011 | Yamashita | F25B 13/00 62/126 |
| 2015/0300676 | A1 | 10/2015 | Motomura et al. | |

FOREIGN PATENT DOCUMENTS

| | | | | |
|---|---|---|---|---|
| KR | 10-2006-0098587 | A | 9/2006 | |
| KR | 10-2014-0000937 | A | 1/2014 | |
| KR | 10-2015-0000158 | A | 1/2015 | |
| KR | 10-2018-0010095 | A | 1/2018 | |
| KR | 1020180010095 | * | 1/2018 | F25D 17/042 |

OTHER PUBLICATIONS

European Search Report dated Aug. 5, 2021, issued in European Application No. 18920622.0.

* cited by examiner

APPARATUS FOR DELIVERING CIRCULATING WATER AND SYSTEM FOR DELIVERING CIRCULATING WATER INCLUDING THE SAME

TECHNICAL FIELD

The present disclosure relates to an apparatus for delivering circulating water and a system for delivering circulating water including the same.

BACKGROUND ART

A typical air conditioning system generally connects a single indoor unit to a single outdoor unit. However, recently, a multi type air conditioning system has been developed and distributed to connect a plurality of indoor units to a large-capacity outdoor unit in order to independently cool and heat separate spaces such as buildings and schools.

In the multi type air conditioning system in which the plurality of indoor units are connected to single outdoor unit, the outdoor unit includes a compressor, a four-way valve, an outdoor heat exchanger, an outdoor fan and an electric expansion valve. Each of the indoor units includes an indoor fan and an indoor heat exchanger.

In the case of a cooling operation in the multi type air conditioning system, high-temperature high-pressure refrigerant discharged from the compressor passes through the four-way valve, the outdoor heat exchanger, and the electric expansion valve, and then flows back into the compressor through the indoor heat exchanger. In the case of a heating operation, high-temperature high-pressure refrigerant discharged from the compressor passes through the four-way valve, the indoor heat exchanger, and the electric expansion valve, and then flows back into the compressor through the outdoor heat exchanger.

On the other hand, in recent years, the demand for energy saving is increasing due to the increase in power consumption, and many regulations for energy saving have been established in each country, and various efforts to reduce energy consumption have been made.

In addition, when the conventional multi type air conditioning system is operated when a temperature is low, such as in winter, an entire system cannot be used even though a part of a refrigerant pipe is frozen.

DISCLOSURE

Technical Problem

An aspect of the present disclosure is to provide an apparatus for delivering circulating water capable of stably operating a system while saving energy is provided by using circulating water for operating a cooling/warming apparatus as a refrigerant for cooling/heating operation or dehumidification operation of indoor units, and a system for delivering circulating water including the same.

Technical Solution

An aspect of the disclosure provides an apparatus for delivering circulating water including: a cooling/warming controller configured to perform heat exchange of circulating water supplied to a cooling/warming apparatus using a refrigerant; an indoor-unit controller configured to perform heat exchange of circulating water supplied to an indoor unit using the refrigerant; and a mode change unit (MCU) configured to control a flow of the refrigerant supplied to the cooling/warming controller and the indoor-unit controller according to an operation mode of the cooling/warming apparatus and the indoor unit. The cooling/warming controller and the indoor-unit controller may be configured to share a circulating water passage through which the circulating water moves.

The circulating water may be composed of water.

The circulating water may include water and alcohol.

The indoor-unit controller may include a cooling/heating controller configured to perform heat exchange of circulating water supplied to an air conditioner using the refrigerant; and a humidity controller configured to perform heat exchange of circulating water supplied to a dehumidifier using the refrigerant.

Among the cooling/heating controller and the humidity controller, the cooling/heating controller may be configured to share the circulating water passage with the cooling/warming controller.

The cooling/warming controller may include a compressor configured to compress the refrigerant; a first heat exchanger configured to perform heat exchange between the refrigerant and the circulating water; and a first expansion valve configured to expand the refrigerant and adjust a flow rate of the refrigerant. The indoor-unit controller may include a second heat exchanger configured to perform heat exchange between the refrigerant and the circulating water; and a second expansion valve configured to expand the refrigerant and adjust the flow rate of the refrigerant.

The apparatus may further include a first circulating water pump configured to move circulating water supplied from the cooling/warming apparatus and the indoor unit to an outdoor unit; a second circulating water pump configured to move circulating water supplied from the cooling/warming apparatus to the cooling/warming controller; and a third circulating water pump configured to move circulating water supplied from the indoor unit to the indoor-unit controller.

The apparatus may further include an electronic valve installed in a circulating water passage connecting the indoor-unit controller and the indoor unit, configured to directly move the circulating water supplied from the outdoor unit to the indoor-unit controller.

The indoor-unit controller may be provided in plurality. The plurality of indoor-unit controllers may be configured to be connected to any one indoor unit.

The MCU may be configured to control opening and closing of the electronic valve to control the flow of the circulating refrigerant supplied to the cooling/warming controller and the indoor-unit controller, respectively.

Another aspect of the disclosure provides a system for delivering circulating water including: an outdoor unit; an indoor unit connected to the outdoor unit through a circulating water passage; a cooling/warming apparatus connected to the outdoor unit through the circulating water passage; and an apparatus for delivering circulating water configured to perform heat exchange of circulating water supplied to a cooling/warming apparatus using a refrigerant, to perform heat exchange of circulating water supplied to an indoor unit using the refrigerant, and to control a flow of the refrigerant supplied to the cooling/warming controller and the indoor-unit controller according to an operation mode of the cooling/warming apparatus and the indoor unit. The indoor unit and the cooling/warming apparatus may be configured to share the circulating water passage through which the circulating water moves.

The apparatus for delivering circulating water may include a cooling/warming controller configured to perform heat exchange of circulating water supplied to a cooling/warming apparatus using a refrigerant; an indoor-unit controller configured to perform heat exchange of circulating water supplied to an indoor unit using the refrigerant; and a mode change unit (MCU) configured to control a flow of the refrigerant supplied to the cooling/warming controller and the indoor-unit controller according to an operation mode of the cooling/warming apparatus and the indoor unit.

The circulating water may be composed of water.

The circulating water may include water and alcohol.

The indoor unit may include an air conditioner and a dehumidifier. The indoor-unit controller may include a cooling/heating controller configured to perform heat exchange of circulating water supplied to an air conditioner using the refrigerant, and a humidity controller configured to perform heat exchange of circulating water supplied to a dehumidifier using the refrigerant.

Among the indoor unit and the air conditioner, the air conditioner may be configured to share the circulating water passage with the cooling/warming apparatus.

The cooling/warming controller may include a compressor configured to compress the refrigerant; a first heat exchanger configured to perform heat exchange between the refrigerant and the circulating water; and a first expansion valve configured to expand the refrigerant and adjust a flow rate of the refrigerant. The indoor-unit controller may include a second heat exchanger configured to perform heat exchange between the refrigerant and the circulating water; and a second expansion valve configured to expand the refrigerant and adjust the flow rate of the refrigerant.

The system may further include a first circulating water pump configured to move circulating water supplied from the cooling/warming apparatus and the indoor unit to an outdoor unit; a second circulating water pump configured to move circulating water supplied from the cooling/warming apparatus to the cooling/warming controller; and a third circulating water pump configured to move circulating water supplied from the indoor unit to the indoor-unit controller.

The system may further include an electronic valve installed in a circulating water passage connecting the indoor-unit controller and the indoor unit, configured to directly move the circulating water supplied from the outdoor unit to the indoor-unit controller.

The MCU may be configured to control opening and closing of the electronic valve to control the flow of the circulating refrigerant supplied to the cooling/warming controller and the indoor-unit controller, respectively.

Advantageous Effects

According to an aspect of an embodiment, by reusing circulating water for operating a cooling/warming apparatus for cooling/heating, it is possible to reduce the energy consumption that had to be additionally used for separate cooling/heating or cooling/warming According to another aspect of an embodiment, by using circulating water for each indoor unit and a cooling/warming apparatus, it is possible to prevent freezing of a system that could occur due to the use of refrigerant. Accordingly, the system may be used stably.

MODES OF THE INVENTION

Figure 1:
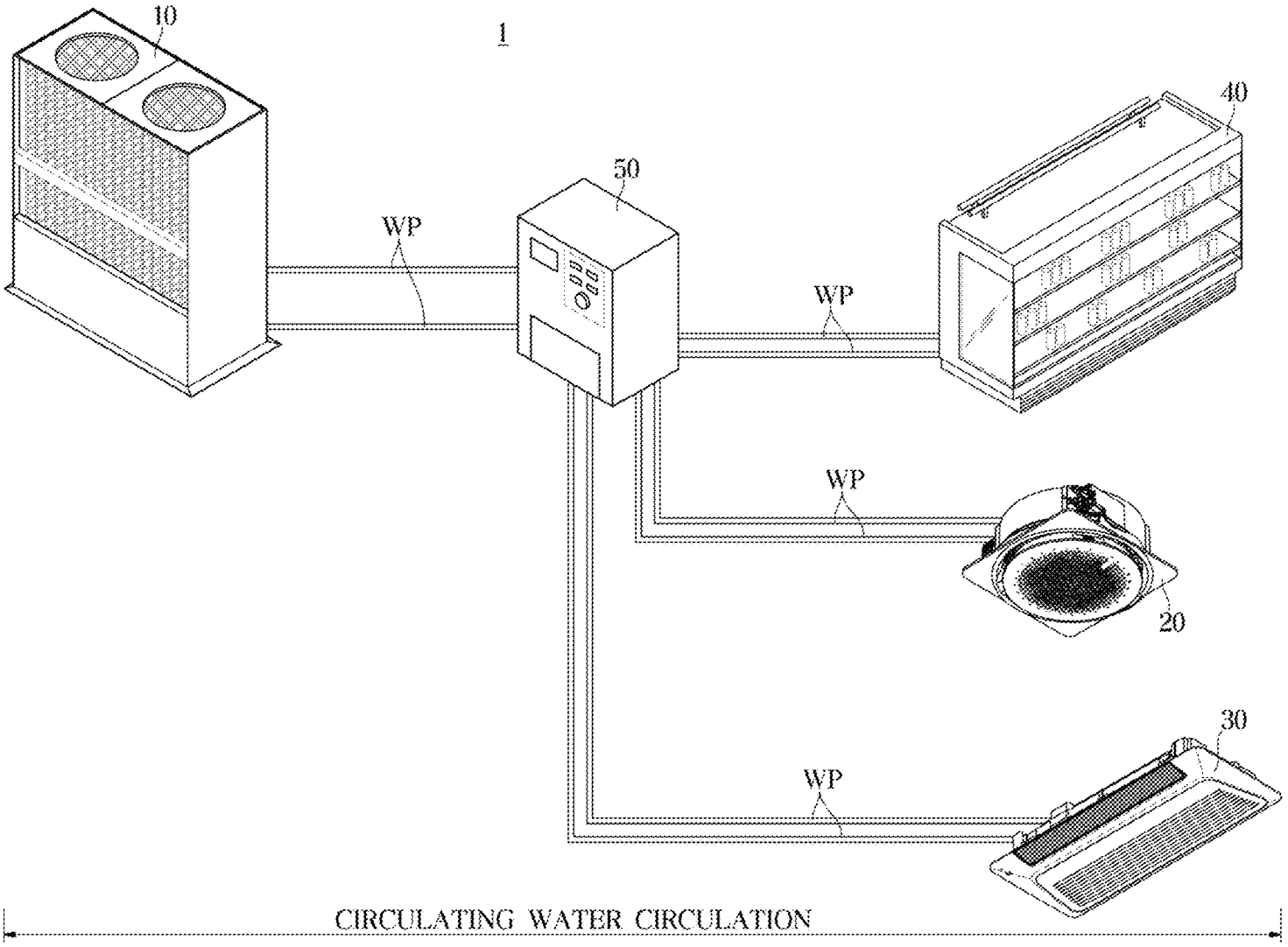
FIG. 1 is a schematic view of a system for delivering circulating water according to an embodiment.

Reference will now be made in detail to the embodiments of the present disclosure, examples of which are illustrated in the accompanying drawings, wherein like reference numerals refer to like elements throughout.

In addition, the same reference numerals or numerals illustrated in each drawing of the present disclosure indicate parts or components that perform substantially the same function.

The terms used in the present application are merely used to describe specific embodiments and are not intended to limit the present disclosure. A singular expression may include a plural expression unless otherwise stated in the context. In the present application, the terms "including" or "having" are used to indicate that features, numbers, steps, operations, components, parts or combinations thereof described in the present specification are present and presence or addition of one or more other features, numbers, steps, operations, components, parts or combinations is not excluded.

In description of the present disclosure, the terms "first" and "second" may be used to describe various components, but the components are not limited by the terms. The terms may be used to distinguish one component from another component. For example, a first component may be called a second component and a second component may be called a first component without departing from the scope of the present disclosure. The term "and/or" may include a combination of a plurality of items or any one of a plurality of items.

An identification code is used for the convenience of the description but is not intended to illustrate the order of each step. Each of the steps may be implemented in an order different from the illustrated order unless the context clearly indicates otherwise.

Hereinafter, the operation principles and embodiments of the disclosure will be described with reference to the accompanying drawings.

Figure 2:
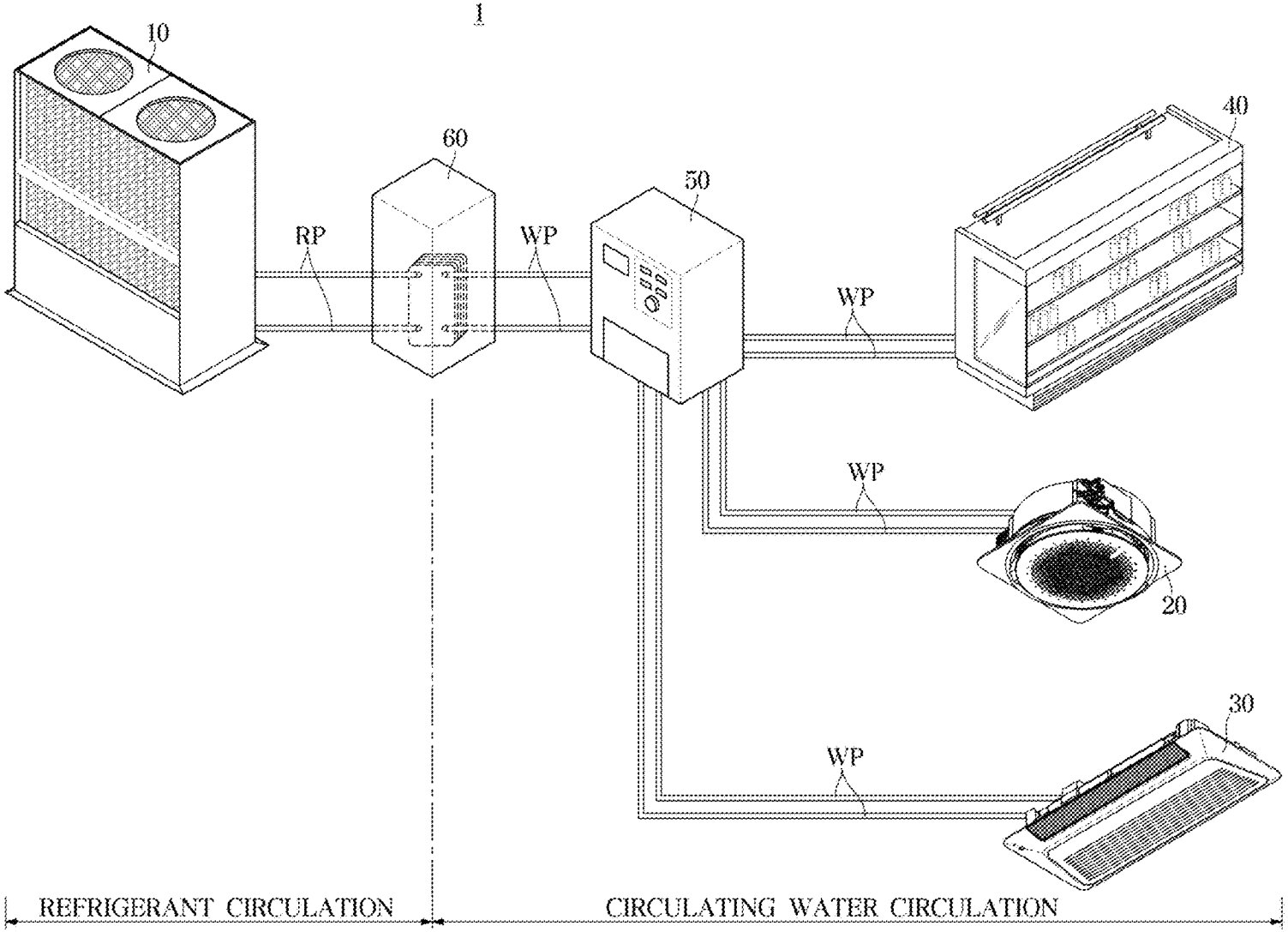
FIG. 2 is a schematic view of a system for delivering circulating water according to another embodiment.

FIG. 1 is a schematic view of a system for delivering circulating water according to an embodiment, and FIG. 2 is a schematic view of a system for delivering circulating water according to another embodiment.

As illustrated in FIG. 1, a system for delivering circulating water 1 according to an embodiment may include an outdoor unit 10 disposed in an outdoor space, a plurality of indoor units 20 and 30 respectively disposed in a plurality of indoor spaces to independently cool/heat each indoor space or perform air conditioning, a cooling/warming apparatus 40 that shares circulating water that carries heat through a circulating water passage WP with the plurality of indoor units 20 and 30 and maintains a temperature of stored items at a constant temperature, and an apparatus for delivering circulating water 50 disposed between the outdoor unit 10 and the plurality of indoor units 20 and 30, and the cooling/ warming apparatus 40. The apparatus for delivering circulating water 50 connects the plurality of indoor units 20 and 30 and the cooling/warming apparatus 40 through circulating water passages WP to deliverer circulating water delivered from one of the plurality of indoor units 20 and 30 and the cooling/warming apparatus 40 to the other so that the circulating water can be reused.

Here, water may be used as the circulating water, but the disclosure is not limited thereto, and other synthetic solutions including water may be used as the refrigerant. For example, circulating water may be a glycol containing water and alcohol. In this way, freezing may be prevented by using water as a medium for heat exchange between the indoor units 20, 30, and 40 and the outdoor unit 10 of the system for delivering circulating water 1.

Hereinafter, the plurality of indoor units 20 and 30 is described as being an air conditioner 20 and a dehumidifier 30, respectively, but is not necessarily limited thereto, and the plurality of indoor units 20 and 30 may be a plurality of air conditioners 20 and 30, or a plurality of dehumidifiers 20 and 30.

The air conditioner 20 and the dehumidifier 30 may be installed inside a building in order to harmonize indoor spaces such as large buildings and high-rise buildings in which a plurality of indoor spaces are provided.

Each indoor space is equipped with the air conditioner 20 and the dehumidifier 30 in a form suitable for the indoor space to harmonize the indoor space. That is, the air conditioner 20 and the dehumidifier 30 may be used in various models such as a stand type, a ceiling type, and a wall-mounted type, and are installed according to a user's selection. The air conditioner 20 and the dehumidifier 30 are installed to communicate with the outdoor unit 10 and the circulating water passage WP. The circulating water passage WP may guide the flow of circulating water between the indoor units 20 and 30 and the outdoor unit 10.

The cooling/warming apparatus 40 may store food refrigerated or warm or frozen. For example, the cooling/warming apparatus 40 may be a storage chamber for accommodating food and a refrigerator, a freezer, a warmer, a refrigerator showcase, a freezing showcase, a warm showcase, etc. for refrigerating, warming, or cooling the storage chamber.

The cooling/warming apparatus 40 may supply cold air or warm air to the storage chamber to prevent deterioration of the food stored in the storage chamber or to maintain the temperature of the stored food.

Referring to FIG. 2, the system for delivering circulating water 1 according to another embodiment may further include a heat exchanger 60 disposed between the outdoor unit 10 and the apparatus for delivering circulating water 50.

The system for delivering circulating water 1 according to another embodiment may share circulating water that carries heat by connecting the plurality of indoor units 20 and 30, the cooling/warming apparatus 40, and the apparatus for delivering circulating water 50 through the circulating water passage WP, the heat exchanger 60 is connected between the apparatus for delivering circulating water 50 and the outdoor unit 10. The heat exchanger 60 may perform heat exchange with the refrigerant circulated in the outdoor unit 10 by condensing the circulating water delivered from the apparatus for delivering circulating water 50. The heat exchanger 60 and the outdoor unit 10 are connected through a refrigerant pipe RP for circulating a separate refrigerant.

Here, as the refrigerant, various refrigerant and air-conditioning refrigerants that can be vaporized by conventional compression such as hydrocarbon such as R410a, R134a, carbon dioxide, propane, and propylene, fluoroethane (HFC161), difluoro ethane (HFC152a), or difluoromethane (HFC32), etc. may be used, but are not limited thereto.

The system for delivering circulating water to be described later will be described by taking the system for delivering circulating water 1 according to an embodiment, but the embodiment of the system for delivering circulating water 1 is not limited thereto.

Hereinafter, a detailed configuration view of the system for delivering circulating water 1 according to an embodiment will be described with reference to FIGS. 4 to 6.

Figure 3:
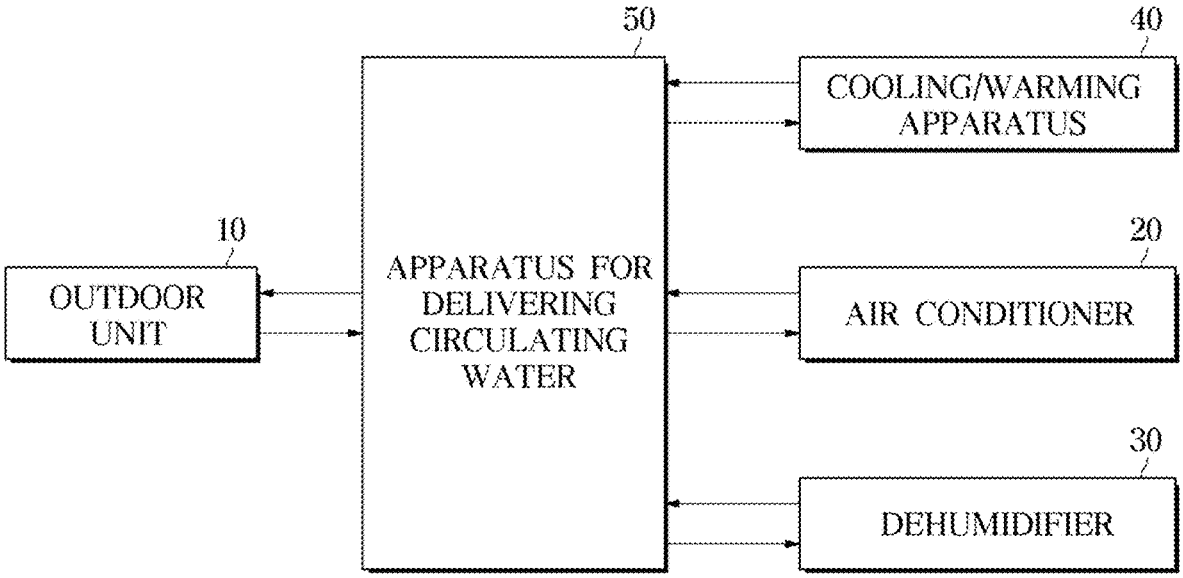
FIG. 3 is a control block diagram of a system for delivering circulating water according to an embodiment.
Figure 4:
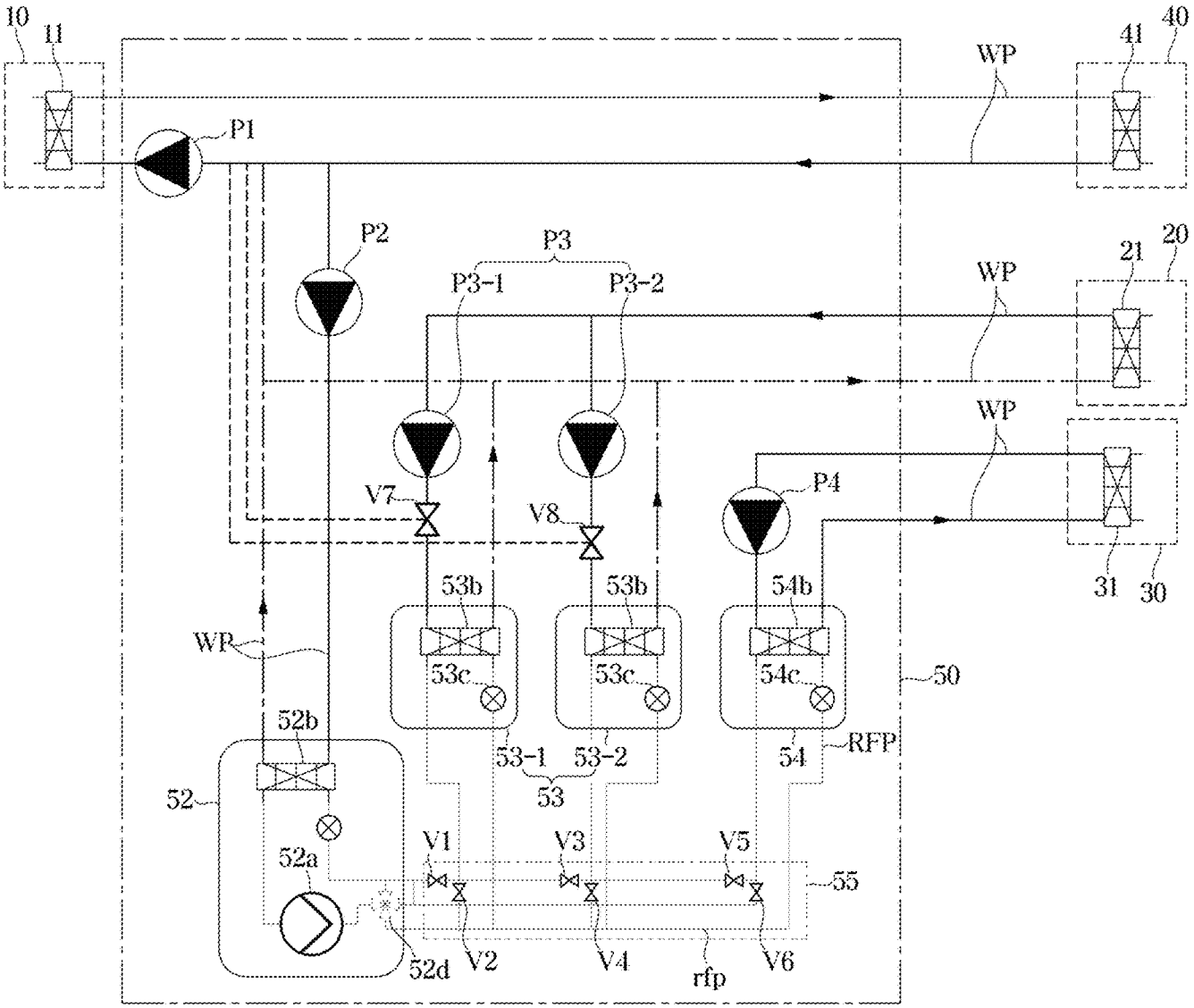
FIG. 4 is a circuit diagram of a system for delivering circulating water according to an embodiment.
Figure 5:
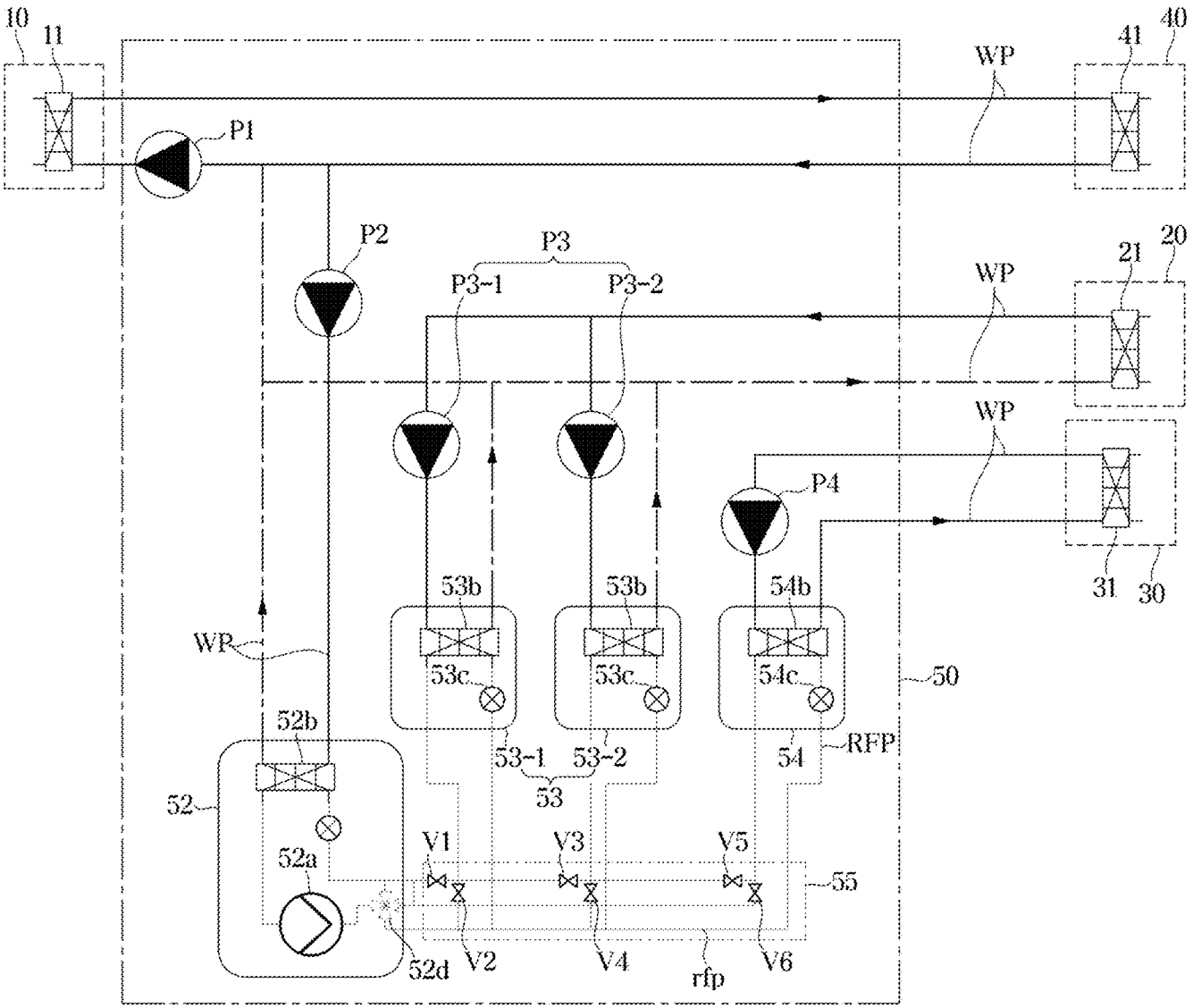
FIG. 5 is a circuit diagram of a system for delivering circulating water according to another embodiment.

FIG. 3 is a control block diagram of a system for delivering circulating water according to an embodiment, FIG. 4 is a circuit diagram of a system for delivering circulating water according to an embodiment, and FIG. 5 is a circuit diagram of a system for delivering circulating water according to another embodiment.

Referring to FIGS. 3 and 4, the apparatus for delivering circulating water 50 may include a cooling/warming controller 52, indoor-unit controllers 53 and 54, and a mode change unit (MCU) 55. The indoor-unit controllers 53 and 54 may include a cooling/heating controller 53 and a humidity controller 54.

The circulating refrigerant in the system for delivering circulating water 1 may circulate through the cooling/warming controller 52, the cooling/heating controller 53, and the humidity controller 54 through a refrigerant passage rfp (a thin solid line).

Here, as the circulating refrigerant, various refrigerant and air-conditioning refrigerants that can be vaporized by conventional compression such as hydrocarbon such as R410a, R134a, carbon dioxide, propane, and propylene, fluoroethane (HFC161), difluoro ethane (HFC152a), or difluoromethane (HFC32), etc. may be used, but are not limited thereto.

The cooling/warming controller 52 is a component of the apparatus for delivering circulating water 50 for controlling the temperature of circulating water supplied to the cooling/warming apparatus 40, and may include a compressor 52*a* for compressing the circulating refrigerant, a first heat exchanger 52*b*, a first expansion valve 52*c*, and a flow passage switching valve 52*d* for performing heat exchange between the circulating refrigerant and circulating water circulating the cooling/warming apparatus 40.

The compressor 52*a* is installed in the cooling/warming controller 52, and compresses the low-pressure circulating refrigerant by using a rotational force of a compressor drive motor that rotates by receiving electric energy from an external power source and pressurizes the compressed high-pressure circulating refrigerant to the first heat exchanger 52*b*. In this way, the circulating refrigerant may circulate the first heat exchanger 52*b* and the first expansion valve 52*c* along the refrigerant passage rfp by the pressure generated by the compressor 52*a*, and also circulate the cooling/heating controller 53 and the humidity controller 54.

The high-pressure circulating refrigerant compressed by the compressor 52*a* may move to the first heat exchanger 52*b* along the refrigerant passage rfp.

The first heat exchanger 52*b* is installed in the cooling/warming controller 52, and may be performed heat exchange between the circulating refrigerant and the circulating water by allowing the refrigerant passage rfp and the circulating water passage WP of the cooling/warming apparatus 40 to cross.

Particularly, the first heat exchanger 52*b* may operate as an evaporator in a refrigerating mode to evaporate the circulating refrigerant to absorb heat from circulating water, and in a warming mode, the first heat exchanger 52*b* may operate as a condenser to condense the circulating refrigerant to dissipate heat from the circulating water passage.

In the refrigerating mode, as the circulating water absorbed by the first heat exchanger 52*b* is supplied to the outdoor unit 10 in a relatively cold state compared to before, a load required for the outdoor unit 10 to perform heat exchange may be reduced. The circulating water heat exchanged by the outdoor unit 10 is supplied to an indoor heat exchanger 41 of the cooling/warming apparatus 40. The indoor heat exchanger 41 of the cooling/warming apparatus 40 may operate as the evaporator to evaporate the circulating water, thereby performing a refrigerating function.

In the warming mode, the circulating water absorbed by the first heat exchanger 52*b* is supplied to the outdoor unit 10 in a relatively warm state compared to before, so that the load of the outdoor unit 10 may be reduced. The circulating water heat exchanged by the outdoor unit 10 is supplied to the indoor heat exchanger 41 of the air conditioner 20, and the indoor heat exchanger 41 of the cooling/warming apparatus 40 may operate as the condenser and condense the circulating water to perform a warming function.

In addition, the circulating water heat exchanged by the first heat exchanger 52*b* is also supplied to the air conditioner 20 and may be used for a cooling operation or a heating operation of the air conditioner 20. Energy efficiency may be increased by sharing the circulating water between the cooling/warming apparatus 40 and the air conditioner 20.

The first heat exchanger 52*b* may adopt a spiral heat exchanger SHE in which two spiral channels are formed to allow the circulating refrigerant and the circulating water to pass through each channel to perform heat exchange between the circulating refrigerant and the circulating water, or a plate heat exchanger PHE that allows heat exchange between the circulating refrigerant and circulating water by alternately flowing the circulating refrigerant and the refrigerant between the heat transfer plates by stacking a plurality of heat transfer plates.

The first expansion valve 52*c* is connected to one side of the first heat exchanger 52*b*.

The first expansion valve 52*c* may be composed of an electronic expansion valve, and may expand the circulating refrigerant circulating the cooling/warming controller 52, adjust a flow rate of the circulating refrigerant, and prevent the flow of the circulating refrigerant. It may be replaced with an expansion device of another structure that performs this function.

The flow passage switching valve 52*d* may be configured as a four-way valve, and switches the flow of the circulating refrigerant discharged from the compressor 52*a* according to an operation mode (refrigerating or warming, and cooling or heating), thereby forming the refrigerant passage rfp required for operation in the corresponding mode.

The cooling/warming controller 52 may further include a memory that stores data about an algorithm for controlling the operation of the components in the cooling/warming controller 52 such as controlling the opening and closing of the flow passage switching valve 52*d* or a program that reproduces the algorithm, and a processor that performs the above-described operation using data stored in the memory. In this case, the memory and the processor may be implemented as separate chips, respectively. Alternatively, the memory and the processor may be implemented as a single chip.

The cooling/heating controller 53 (53-1, 53-2) is a component of the apparatus for delivering circulating water 50 for adjusting the temperature of circulating water supplied to the air conditioner 20, and may include a second heat exchanger 53*b* for performing heat exchange between the circulating refrigerant and the circulating water circulating the air conditioner 20, and a second expansion valve 53*c*.

In FIG. 4, two cooling/heating controllers 53-1 and 53-2 are illustrated to perform heat exchange by being connected to the circulating water passage WP of the air conditioner 20, but the cooling/heating controller 53 included in the apparatus for delivering circulating water 50 may be one, or three or more, but is not limited to the number illustrated.

The second heat exchanger 53*b* is installed in the cooling/heating controller 53, and may be performed heat exchange between the circulating refrigerant and the circulating water by allowing the refrigerant passage rfp and the circulating water passage WP of the air conditioner 20 to cross.

Particularly, the second heat exchanger 53*b* may operate as the evaporator in a cooling mode to evaporate the circulating refrigerant to absorb heat from circulating water, and in a heating mode, the second heat exchanger 53*b* may operate as the condenser to condense the circulating refrigerant to dissipate heat from the circulating water passage.

In the cooling mode, as the circulating water absorbed by the second heat exchanger 53*b* is supplied to the outdoor unit 10 in the relatively cold state compared to before, the load of the outdoor unit 10 may be reduced.

In the heating mode, the circulating water absorbed by the second heat exchanger 53*b* is supplied to the outdoor unit 10 in the relatively warm state compared to before, so that the load of the outdoor unit 10 may be reduced.

In addition, the circulating water heat exchanged by the second heat exchanger 53*b* is also supplied to the air conditioner 20 and may be used for the cooling operation or the heating operation of the air conditioner 20. Energy efficiency may be increased by sharing the circulating water between the cooling/warming apparatus 40 and the air conditioner 20.

Particularly, the circulating water absorbed by heat in the cooling mode is supplied to the indoor heat exchanger 21 of the air conditioner 20 in the cold state, and the indoor heat exchanger 21 of the air conditioner 20 may operates as the evaporator to evaporate the circulating water to cool the surrounding air.

The circulating water absorbing heat in the heating mode is supplied to the indoor heat exchanger 21 of the air conditioner 20 in a warmed state, and the indoor heat exchanger 21 of the air conditioner 20 may operate as the condenser to condense circulating water to heat the surrounding air.

The second heat exchanger 53*b* may adopt the spiral heat exchanger SHE in which two spiral channels are formed to allow the circulating refrigerant and the circulating water to pass through each channel to perform heat exchange between the circulating refrigerant and the circulating water, or the plate heat exchanger PHE that allows heat exchange between the circulating refrigerant and circulating water by alternately flowing the circulating refrigerant and the refrigerant between the heat transfer plates by stacking a plurality of heat transfer plates.

The second expansion valve 53*c* is connected to one side of the second heat exchanger 53*b*.

The second expansion valve 53*c* may be composed of an electronic expansion valve, and may expand the circulating refrigerant circulating the cooling/heating controller 53, adjust a flow rate of the circulating refrigerant, and prevent the flow of the circulating refrigerant. It may be replaced with an expansion device of another structure that performs this function.

Meanwhile, referring to FIG. 5, in an emergency situation where cooling/heating must be performed in a short time, the cooling/heating controller 53 is directly connected to the outdoor unit 10 to receive circulating water directly from the outdoor unit 10. To this end, the system for delivering circulating water 1 according to another embodiment may further include emergency electronic valves V7 and V8.

The cooling/heating controller 53 may directly supply the circulating water heat exchanged in the outdoor unit 10 to the cooling/heating controller 53 by controlling the emergency electronic valves V7 and V8 installed in the circulating water passage WP between the cooling/heating controller 53 and the outdoor unit 10.

The cooling/heating controller 53 may determine whether there is an emergency situation according to the user's input, or may determine as the emergency situation when an outdoor temperature detected by an outdoor temperature sensor is greater than or less than a preset reference value.

Alternatively, the cooling/heating controller 53 may determine whether there is the emergency situation based on a control signal received from the MCU 55 and control the emergency electronic valves V7 and V8 based on the control signal.

In FIG. 5, the emergency electronic valves V7 and V8 are illustrated as being installed outside the cooling/heating controller 53, but may be installed inside the cooling/heating controller 53.

The cooling/heating controller 53 may further include the memory that stores data about an algorithm for controlling the operation of the components in the cooling/heating controller 53 such as controlling the opening and closing of the emergency electronic valves V7 and V8 or a program that reproduces the algorithm, and the processor that performs the above-described operation using data stored in the memory. In this case, the memory and the processor may be implemented as separate chips, respectively. Alternatively, the memory and the processor may be implemented as the single chip.

Meanwhile, in the above-described embodiment, the processor of the cooling/heating controller 53 has been described as controlling the emergency electronic valves V7 and V8, but it is also possible for the processor to control the emergency electronic valves V7 and V8.

The humidity controller 54 is a component of the apparatus for delivering circulating water 50 for adjusting the temperature of circulating water supplied to the dehumidifier 30, and may include a third heat exchanger 54*b* for performing heat exchange between the circulating refrigerant and the circulating water circulating the dehumidifier 30, and a third expansion valve 54*c*.

In FIG. 4, one humidity controller 54 is illustrated to perform heat exchange by being connected to the circulating water passage WP of the dehumidifier 30. However, the humidity controller 54 included in the apparatus for delivering circulating water 50 may be two or more, but is not limited to the number illustrated.

The third heat exchanger 54*b* is installed in the humidity controller 54, and may be performed heat exchange between the circulating refrigerant and the circulating water by allowing the refrigerant passage rfp and the circulating water passage WP of the dehumidifier 30 to cross.

Particularly, when a dehumidification operation is performed, the third heat exchanger 54*b* may operate as the evaporator to evaporate the circulating refrigerant to absorb heat of circulating water. The circulating water that has absorbed heat is supplied to the indoor heat exchanger 31 of the dehumidifier 30 in the cold state, and the indoor heat exchanger 31 of the dehumidifier 30 may perform a dehumidifying function of air by condensing the surrounding water vapor.

The circulating water heat exchanged by the dehumidifier 30 may be supplied to the third heat exchanger 54*b* to perform heat exchange with the circulating refrigerant.

The third heat exchanger 54*b* may adopt the spiral heat exchanger SHE in which two spiral channels are formed to allow the circulating refrigerant and the circulating water to pass through each channel to perform heat exchange between the circulating refrigerant and the circulating water, or the plate heat exchanger PHE that allows heat exchange between the circulating refrigerant and circulating water by alternately flowing the circulating refrigerant and the refrigerant between the heat transfer plates by stacking a plurality of heat transfer plates.

The third expansion valve 54*c* is connected to one side of the third heat exchanger 54*b*.

The third expansion valve 54*c* may be composed of the electronic expansion valve, and may expand the circulating refrigerant circulating the humidity controller 54, adjust the flow rate of the circulating refrigerant, and prevent the flow of the circulating refrigerant. It may be replaced with an expansion device of another structure that performs this function.

The humidity controller 54 may further include the memory that stores data about an algorithm for controlling the operation of the components in the humidity controller 54 such as controlling the opening and closing of the emergency electronic valves V7 and V8 or a program that reproduces the algorithm, and the processor that performs the above-described operation using data stored in the memory. In this case, the memory and the processor may be implemented as separate chips, respectively. Alternatively, the memory and the processor may be implemented as the single chip.

The MCU 55 may control or guide the flow of the supplied circulating refrigerant supplied to each of the cooling/warming controller 52, the cooling/heating controller 53, and the humidity controller 54 by controlling the opening and closing of one or more electronic valves V1 to V6. The MCU 55 may switch on and off of refrigerating and warming operations of the cooling/warming apparatus 40, the cooling and heating operations of the air conditioner 20, and the dehumidification operation of the dehumidifier 30.

For example, the MCU 55 may control opening and closing of the electronic valves V1 to V6 and the flow passage switching valve 52*d* based on an outdoor temperature detection result detected from the outdoor temperature sensor, a desired temperature of the cooling/warming apparatus 40 received from the user, and a desired cooling/heating temperature.

The MCU 55 may further include the memory that stores data about an algorithm for controlling the operation of the components in the system for delivering circulating water 1 such as controlling the opening and closing of the electronic valves V1 to V6 or a program that reproduces the algorithm, and the processor that performs the above-described operation using data stored in the memory. In this case, the memory and the processor may be implemented as separate chips, respectively. Alternatively, the memory and the processor may be implemented as the single chip.

In the above-described embodiment, it has been described that the processor of the cooling/warming controller 52, the processor of the cooling/heating controller 53, the processor of the humidity controller 54, and the processor of the MCU 55 are provided separately, but at least two or more may be combined to perform each function.

In addition, in the above-described embodiment, it has been described that the memory of the cooling/warming controller 52, the memory of the cooling/heating controller 53, the memory of the humidity controller 54, and the memory of the MCU 55 are provided separately, but at least two or more may be combined to perform each function.

Meanwhile, the circulating water heat exchanged by the first heat exchanger 52*b* of the cooling/warming controller 52, the second heat exchanger 53*b* of the cooling/heating controller 53, and the third heat exchanger 54*b* of the humidity controller 54 may be supplied to the outdoor unit 10 and move to an outdoor heat exchanger 11 provided in the outdoor unit 10.

The outdoor heat exchanger 11 may operate as the condenser to lower the temperature of circulating water and operate as the evaporator to increase the temperature of circulating water. A first circulating water pump P1 may be further mounted on one side of the outdoor heat exchanger 11, and the first circulating water pump P1 may be moved circulating water supplied from the cooling/warming apparatus 40, the air conditioner 20, the dehumidifier 30, and the apparatus for delivering circulating water 50 to the outdoor heat exchanger 11.

A second circulating water pump P2 installed in the circulating water passage WP connecting the cooling/warming apparatus 40 and the cooling/warming controller 52 may be moved the circulating water to the cooling/warming controller 52 so that the circulating water supplied from the cooling/warming apparatus 40 is heat exchanged in the cooling/warming controller 52. In this case, the second circulating water pump P2 may be moved part of the circulating water supplied from the cooling/warming apparatus 40 to the cooling/warming controller 52, and may be moved the remaining part toward the outdoor unit 10.

A third circulating water pump P3 installed in the circulating water passage WP connecting the air conditioner 20 and the cooling/heating controller 53 may be moved the circulating water the cooling/heating controller 53 so that the circulating water supplied from the air conditioner 20 is heat exchanged in the cooling/heating controller 53.

When two cooling/heating controllers 53-1 and 53-2 are provided as illustrated in FIG. 4, one third circulating water pump P3-1 may be moved a part of the circulating water supplied from the air conditioner 20 to any one cooling/heating controller 53-1, and the other third circulating water pump P3-2 may be moved the remaining of the circulating water supplied from the air conditioner 20 to another cooling/heating controller 53-2.

A fourth circulating water pump P4 mounted on the circulating water passage WP connecting the dehumidifier 30 and the humidity controller 54 may be moved the circulating water to the dehumidifier 54 so that the circulating water supplied from the dehumidifier 30 is heat exchanged in the humidity controller 54.

In this case, the fourth circulating water pump P4 may be moved all of the circulating water supplied from the dehumidifier 30 to the dehumidifier 54.

At least one component may be added or deleted corresponding to the performance of the components in the system for delivering circulating water 1 illustrated in FIGS. 4 and 5. It will be readily understood by those skilled in the art that the mutual position of the components may be changed corresponding to the performance or structure of the system.

Hereinafter, a flow path of circulating water according to the operation mode of the system for delivering circulating water 1 according to an embodiment will be described with reference to FIG. 6.

Figure 6:
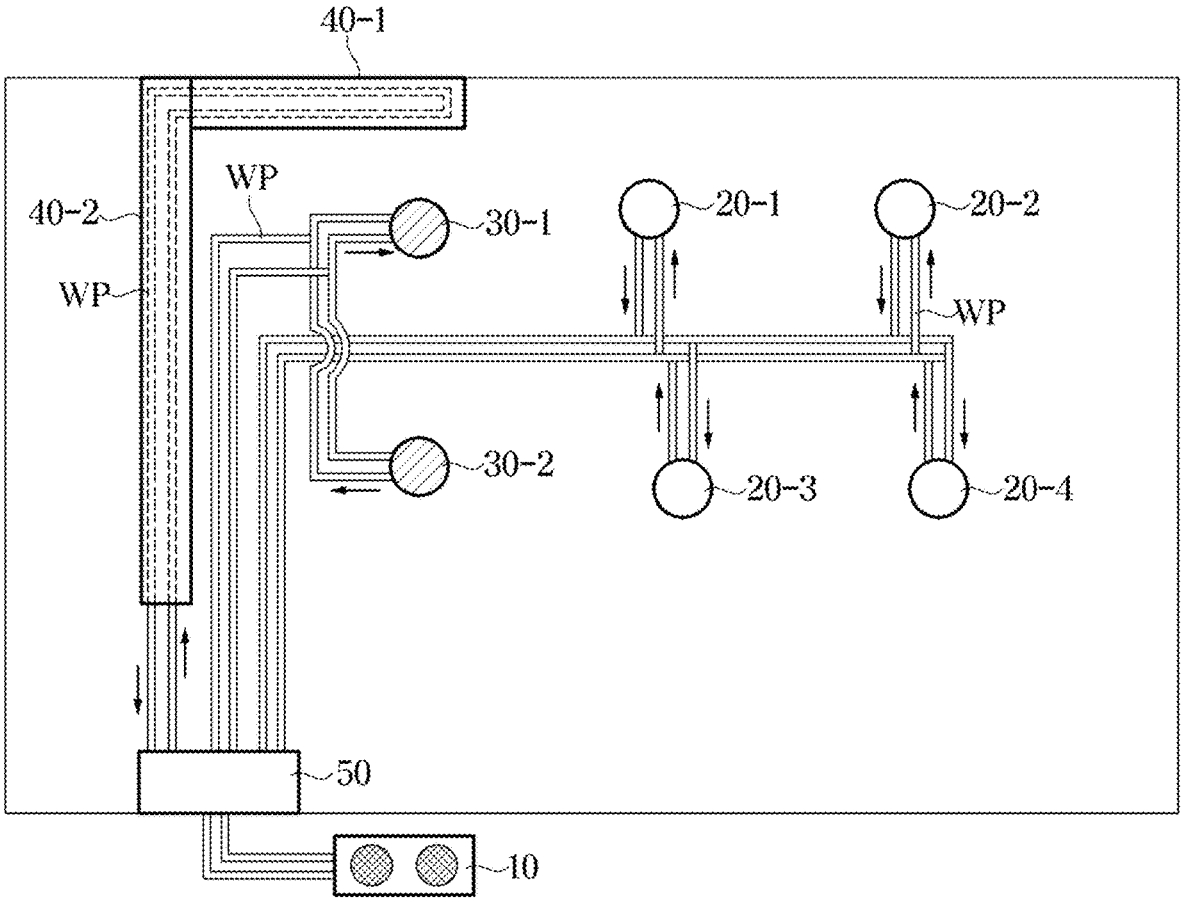
FIG. 6 is a view illustrating a space to which a system for delivering circulating water is applied according to an embodiment.

FIG. 6 is a view illustrating a space to which a system for delivering circulating water is applied according to an embodiment.

In FIG. 6, although two cooling/warming apparatuses 40-1 and 40-2, four air conditioners 20-1 to 20-4, and two dehumidifiers 30-1 and 30-2 are illustrated as being connected to the delivering circulating water 50, the number of the apparatus for delivering circulating water 50, the cooling/warming apparatus 40, the air conditioner 20, and the dehumidifier 30 is not limited thereto.

Each of cooling/warming apparatuses 40-1 and 40-2 is directly connected through the apparatus for delivering circulating water 50 through the circulating water passage WP. Any one cooling/warming apparatus 40-2 is directly connected to the apparatus for delivering circulating water 50 through the circulating water passage WP, and another cooling/warming apparatus 40-2 is directly connected to one cooling/warming apparatus 40-2 through the circulating water passage WP. Another cooling/warming apparatus 40-2 may be connected to the apparatus for delivering circulating water 50 through one cooling/warming apparatus 40-1.

Each of air conditioners 20-1 to 20-4 is also directly connected to the apparatus for delivering circulating water 50 through the circulating water passage WP, or the air conditioner 20-1 is directly connected to the apparatus for delivering circulating water 50 through the circulating water passage WP and the air conditioner 20-2 is directly connected to any one air conditioner 20-1 through the circulating water passage WP, and the air conditioner 20-3 is directly connected to the other air conditioner 20-4 through the circulating water passage WP, and the air conditioner 20-4 is directly connected to the other air conditioner 20-1. Accordingly, all air conditioners 20-1 to 20-4 may be connected to the apparatus for delivering circulating water 50.

Each of the dehumidifiers 30-1 and 30-2 is also directly connected to the apparatus for delivering circulating water 50 through the circulating water passage WP, or one dehumidifier 30-1 is directly connected to the apparatus for delivering circulating water 50 through the circulating water passage WP, and the other dehumidifier 30-2 is directly connected to one dehumidifier 30-1 through the circulating water passage WP, so that all dehumidifiers 30-1 and 30- 2 may be connected to the apparatus for delivering circulating water 50.

The humidity controller 54 of the apparatus for delivering circulating water 50 may first supply cold circulating water to the dehumidifier 30 for dehumidification operation of the dehumidifier 30.

The circulating water passing through the indoor heat exchanger 31 of each of the dehumidifiers 30-1 and 30-2 is again supplied to the humidity controller 54 of the apparatus for delivering circulating water 50, and may be supplied to each of the dehumidifiers 30-1 and 30-2 in the cold state again by performing heat exchange with the circulating refrigerant in the heat exchanger 54*b* of the humidity controller 54. Although not illustrated, the humidity controller 54 may also be provided to correspond to the number of dehumidifiers 30-1 and 30-2, and the plurality of humidity controllers 54 may perform heat exchange of circulating water supplied from the corresponding dehumidifiers 30-1 and 30-2, respectively.

In addition, the cooling/heating controller 53 of the apparatus for delivering circulating water 50 may supply cold circulating water to each of the air conditioners 20-1 to 20-4 for the cooling operation of the air conditioners 20-1 to 20-4. In this case, the cooling/heating controller 53 may supply only part of the cold circulating water to the air conditioners 20-1 to 20-4 and the remaining to the outdoor unit 10.

The circulating water passing through the indoor heat exchanger 21 of each of air conditioners 20-1 to 20-4 is again supplied to the cooling/heating controller 53 of the apparatus for delivering circulating water 50, and may be supplied to each of air conditioners 20-1 to 20-4 in the cold state again by performing heat exchange with the circulating refrigerant in the heat exchanger 53*b* of the cooling/heating controller 53. Although not illustrated, the cooling/heating controller 53 may also be provided to correspond to the number of air conditioners 20-1 to 20-4, and the plurality of cooling/heating controllers 53 may perform heat exchange of circulating water supplied from the corresponding air conditioners 20-1 to 20-4, respectively.

In addition, the cooling/heating controller 53 of the apparatus for delivering circulating water 50 may supply warm circulating water to each of the air conditioners 20-1 to 20-4 for the heating operation of the air conditioners 20-1 to 20-4. In this case, the cooling/heating controller 53 may supply only part of the warm circulating water to the air conditioners 20-1 to 20-4 and the remaining to the outdoor unit 10.

The circulating water passing through the indoor heat exchanger 21 of each of air conditioners 20-1 to 20-4 is again supplied to the cooling/heating controller 53 of the apparatus for delivering circulating water 50, and may be supplied to each of air conditioners 20-1 to 20-4 in the warmed state again by performing heat exchange with the circulating refrigerant in the heat exchanger 53*b* of the cooling/heating controller 53. Although not illustrated, the cooling/heating controller 53 may also be provided to correspond to the number of air conditioners 20-1 to 20-4, and the plurality of cooling/heating controllers 53 may perform heat exchange of circulating water supplied from the corresponding air conditioners 20-1 to 20-4, respectively.

In addition, the cooling/warming controller 52 of the apparatus for delivering circulating water 50 may supply circulating water to the outdoor unit 10 for the refrigerating operation of the cooling/warming apparatuses 40-1, 40-2, and the circulating water heat exchanged by the outdoor unit 10 may be supplied to each of the cooling/warming apparatuses 40-1 and 40-2. In this case, the cooling/warming controller 52 may supply only part of the cold circulating water to the outdoor unit 10 and supply the remaining to the air conditioners 20-1 to 20-4.

The circulating water passing through the outdoor heat exchanger 11 of the outdoor unit 10 is again supplied to the cooling/warming controller 52 of the apparatus for delivering circulating water 50, and may be supplied to the outdoor unit 10 and each of air conditioners 20-1 to 20-4 in the cold state again by performing heat exchange with the circulating refrigerant in the heat exchanger 52*b* of the cooling/warming controller 52. Although not illustrated, the cooling/warming controller 52 may also be provided to correspond to the number of cooling/warming apparatuses 40-1 and 40-2, and the plurality of cooling/warming controller 52 may perform heat exchange of circulating water supplied from the corresponding cooling/warming apparatuses 40-1 and 40-2, respectively.

In addition, the cooling/warming controller 52 of the apparatus for delivering circulating water 50 may supply circulating water to the outdoor unit 10 for the warming operation of the cooling/warming apparatuses 40-1, 40-2, and the circulating water heat exchanged by the outdoor unit 10 may be supplied to each of the cooling/warming apparatuses 40-1 and 40-2. In this case, the cooling/warming controller 52 may supply only part of the warmed circulating water to the outdoor unit 10 and supply the remaining to the air conditioners 20-1 to 20-4.

The circulating water passing through the outdoor heat exchanger 11 of the outdoor unit 10 is again supplied to the cooling/warming controller 52 of the apparatus for delivering circulating water 50, and may be supplied to the outdoor unit 10 and each of air conditioners 20-1 to 20-4 in the warmed state again by performing heat exchange with the circulating refrigerant in the heat exchanger 52*b* of the cooling/warming controller 52. Although not illustrated, the cooling/warming controller 52 may also be provided to correspond to the number of cooling/warming apparatuses 40-1 and 40-2, and the plurality of cooling/warming controller 52 may perform heat exchange of circulating water supplied from the corresponding cooling/warming apparatuses 40-1 and 40-2, respectively.

Embodiments and examples of the disclosure have thus far been described with reference to the accompanying drawings. It will be obvious to those of ordinary skill in the art that the disclosure may be practiced in other forms than the embodiments as described above without changing the technical idea or essential features of the disclosure. The above embodiments are only by way of example, and should not be interpreted in a limited sense.

The invention claimed is:

1. An apparatus for delivering circulating liquid, the apparatus comprising:

an at least one of cooling or warming controller configured to perform heat exchange of the circulating liquid that is supplied to an at least one of cooling or warming apparatus to one of evaporate or condense a refrigerant, the at least one of cooling or warming apparatus being a food storage configured to store food refrigerated, warm, or frozen;

an indoor-unit controller configured to perform heat exchange of the circulating liquid that is supplied to an indoor unit using the refrigerant that is one of evaporated or condensed by the at least one of cooling or warming controller;

a mode change unit (MCU) configured to control a flow of the refrigerant that is supplied to the at least one of cooling or warming controller and the indoor-unit controller according to an operation mode of the at least one of cooling or warming apparatus and the indoor unit, wherein the at least one of cooling or warming controller and the indoor-unit controller are configured to share a circulating liquid passage through which the circulating liquid flows;

a first pump configured to deliver the circulating liquid from the at least one of cooling or warming apparatus and the indoor unit to an outdoor unit; and a second pump configured to deliver the circulating liquid from the at least one of cooling or warming apparatus to the at least one of cooling or warming controller, wherein the circulating liquid that has passed through the at least one of cooling or warming controller is supplied to the outdoor unit and the indoor unit by the circulating liquid passage, and wherein the circulating liquid comprises water.

2. The apparatus according to claim 1, wherein the circulating liquid consists of water.

3. The apparatus according to claim 1, wherein the circulating liquid additionally comprises alcohol.

4. The apparatus according to claim 1, wherein the indoor-unit controller comprises:

at least one of cooling or heating controller configured to perform heat exchange of the circulating liquid that is supplied to an air conditioner using the refrigerant that is one of evaporated or condensed by the at least one of cooling or warming controller; and a humidity controller configured to perform heat exchange of the circulating liquid that is supplied to a dehumidifier using the refrigerant that is one of evaporated or condensed by the at least one of cooling or warming controller.

5. The apparatus according to claim 4, wherein at least one of the at least one of cooling or heating controller or the humidity controller is configured to share the circulating liquid passage with the at least one of cooling or warming controller.

6. The apparatus according to claim 1, wherein the at least one of cooling or warming controller comprises:

a compressor configured to compress the refrigerant;

a first heat exchanger configured to perform heat exchange between the refrigerant and the circulating liquid; and a first expansion valve configured to expand the refrigerant and adjust a flow rate of the refrigerant, and wherein the indoor-unit controller comprises:

a second heat exchanger configured to perform heat exchange between the refrigerant and the circulating liquid; and a second expansion valve configured to expand the refrigerant and adjust the flow rate of the refrigerant.

7. The apparatus according to claim 1, further comprising:

a third pump configured to move the circulating liquid that is supplied from the indoor unit to the indoor-unit controller.

8. The apparatus according to claim 1, further comprising:

an electronic valve installed in the circulating liquid passage connecting the indoor-unit controller and the indoor unit, configured to control the flow of the circulating liquid that is supplied from an outdoor unit to the indoor-unit controller.

9. The apparatus according to claim 8, wherein the MCU is configured to control opening and closing of the electronic valve to control the flow of the refrigerant that is supplied to the at least one of cooling or warming controller and the indoor-unit controller, respectively.

10. The apparatus according to claim 1, wherein there is a plurality of the indoor-unit controller, and wherein the plurality of indoor-unit controllers are configured to be connected to the indoor unit.

* * * * *